United States Patent [19]

Shavit

[11] 3,982,583

[45] Sept. 28, 1976

[54] OPTIMIZED AIR CONDITIONING SYSTEM

[75] Inventor: Gideon Shavit, Highland Park, Ill.

[73] Assignee: Honeywell Inc., Minneapolis, Minn.

[22] Filed: Dec. 30, 1974

[21] Appl. No.: 537,287

[52] U.S. Cl. ..... 165/16; 62/412

[51] Int. Cl.[2] ..... F24F 11/02

[58] Field of Search ..... 165/16; 236/1 B, 1 C; 62/412, 186

[56] References Cited

UNITED STATES PATENTS

| | | | |
|---|---|---|---|
| 2,243,647 | 5/1941 | Otto | 165/16 X |
| 3,776,214 | 12/1973 | Coffman | 126/113 |
| 3,840,001 | 10/1974 | Ernest | 126/113 |

*Primary Examiner*—William E. Wayner

*Attorney, Agent, or Firm*—Trevor B. Joike

[57] ABSTRACT

A system, particularly useful in a variable volume air conditioning system, is provided to insure that a predetermined amount of fresh air is taken into a building by the air conditioning system and includes an air property sensor for sensing the air in the system and for regulating a damper means to maintain the minimum outdoor air at a predetermined value.

22 Claims, 2 Drawing Figures

OPTIMIZED AIR CONDITIONING SYSTEM

BACKGROUND OF THE INVENTION

The invention relates to air conditioning systems and particularly to a control apparatus for insuring that, at all times during the year, a predetermined minimum amount of fresh air is taken into the building in which the air conditioning system is located.

In order to insure comfortable working conditions or living conditions in large buildings or large building complexes, local codes generally require that a minimum amount of fresh air be supplied to the building during its occupancy. In some cases, particularly in the case of a variable volume system, it is difficult to maintain a predetermined flow of fresh air into the building.

A typical variable volume system will include a plurality of zones the temperature in each of which is to be controlled. Each zone is supplied with conditioned air through an associated variable damper the position of which is controlled by a thermostat located in its associated zone. Return air from each of the zones is supplied to a mixing chamber through a return air damper and is mixed with fresh air from a variable fresh air damper. The mixture of fresh air and return air, as well as the minimum fresh air supplied through a minimum fresh air damper, are temperature and humidity treated and supplied to the zones by a fan. The system also includes a static pressure sensor located in the output of the fan which senses the pressure of output and regulates the fan accordingly. Under certain conditions, it is possible for this system to fail to supply the minimum amount of fresh air provided for in the local codes.

These conditions may exist, for example, where the temperature outdoors is very cold and, therefore, the variable fresh air damper is closed. Assuming that the thermostat located in one of the zones calls for a reduction in the air supplied to the zone, the damper will begin to close which will increase the static output pressure of the fan. This increase in pressure is sensed by the static pressure sensor and is used to reduce the amount of air being discharged by the fan. This reduction will result in a reduction of the amount of return air being drawn into the system and a reduction in the amount of minimum fresh air supplied through the minimum fresh air damper.

Thus, it can be seen that an arrangement must be provided to insure that a minimum amount of fresh air is always supplied to the air conditioning system.

SUMMARY OF THE INVENTION

The present invention provides a control apparatus to insure that a minimum amount of fresh air is supplied to the system at all times. This control apparatus may include an air property sensor in the form of a static pressure sensor for sensing the static pressure at the output of the fan, a flow sensor for sensing the flow of air from the minimum outdoor air damper, or a combination of both the static pressure sensor and the flow sensor. These sensors are utilized to control the dampers of the air conditioning systems to insure that a minimum amount of fresh air is taken into the system. The dampers, which can be regulated, may be the damper located to control the mixture of return air and variable outdoor air, the minimum outdoor air damper, the variable outdoor air damper, the return air damper or a combination of these. As stated above, the control apparatus is particularly useful in a variable volume system although the invention is not necessarily limited thereto.

BRIEF DESCRIPTION OF THE DRAWINGS

Other advantages of this system may be seen from a consideration of the drawings in which.

DETAILED DESCRIPTION OF THE DRAWING

Figure 1:
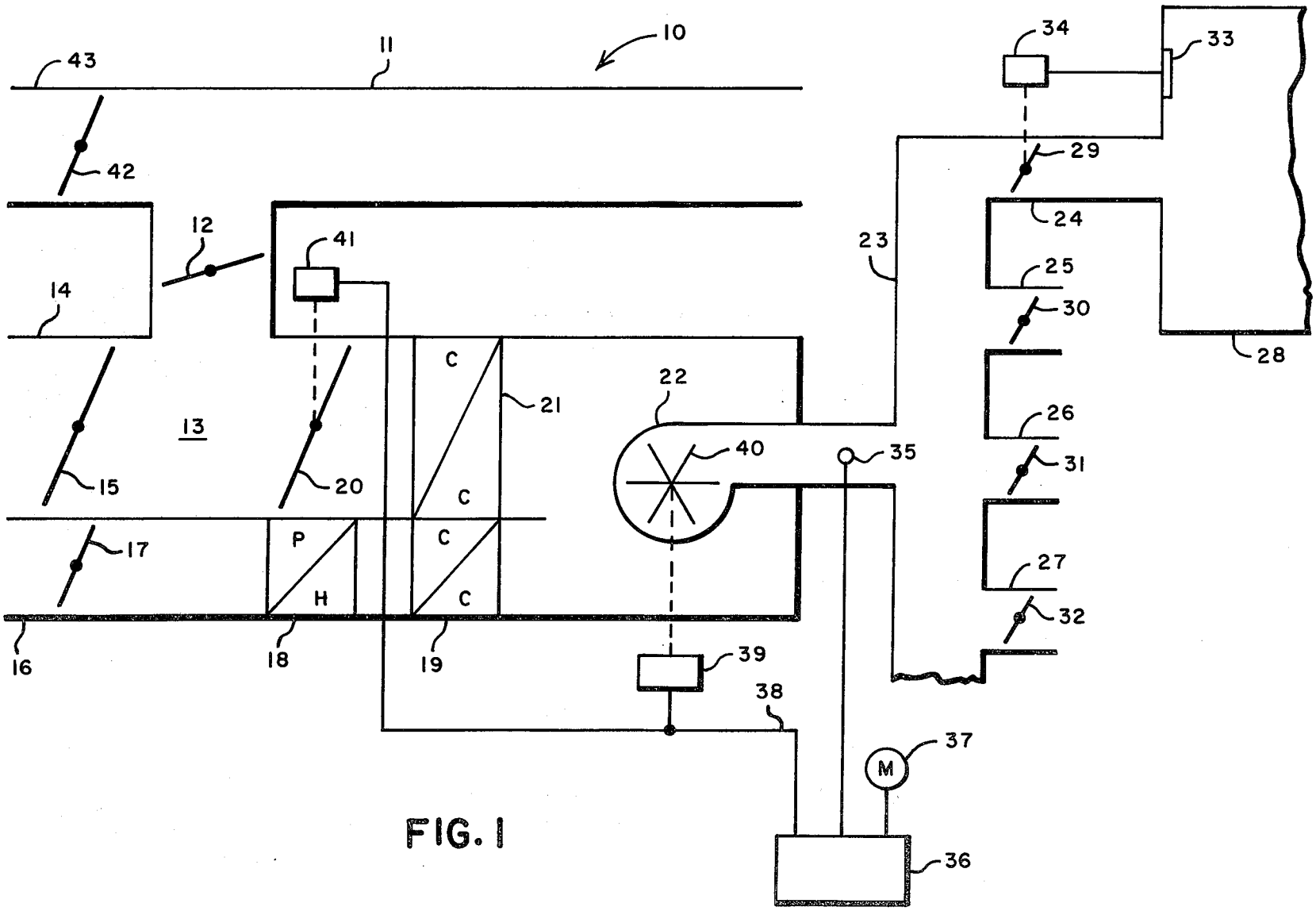
FIG. 1 shows one form of the apparatus in which a static pressure sensor controls both the vortex damper of the fan and a damper located to control the flow of the mixture of variable outdoor air and return air; and, FIG. 2 shows another form of the apparatus in which a static pressure sensor controls the fan and a flow sensor sensing the flow of minimum outdoor air controls the mixing damper and the damper controlling the minimum outdoor air supplied to this system.

In FIG. 1, an air conditioning system is generally shown at 10 and comprises a return air duct 11 for supplying a return air from the zones through a return air damper 12 to a mixing chamber 13. A source of variable outdoor air is provided by a duct 14 through a variable outdoor air damper 15 to mixing chamber 13. A source of minimum outdoor air, duct 16 and damper 17, supplies fresh air to a pre-heat coil 18 for preheating the minimum outdoor air supplied to cooling coil 19 for cooling. The mixture of air in mixing chamber 13 is supplied through a mixing damper 20 and through a cooling coil 21. A fan 22 discharges the combination of mixed air from the mixing chamber 13 and minimum outdoor air from minimum outdoor air damper 17 to a discharge duct 23. This discharged air is supplied through a plurality of zone ducts 24, 25, 26, 27 to an associated one of plurality of zones one of which is shown at 28. A plurality of zone dampers 29, 30, 31, 32 are located in an associated zone duct for controlling the amount of discharged air supplied to its associated zone. A thermostat is located in each of the zones for the control of the zone damper to thus regulate the amount of discharged air supplied to that zone. Only one such control, thermostat 33, is shown and is located in zone 28. The output from thermostat 33 is used to control the motor 34 for positioning the damper 29 at a position dependent upon the temperature of the zone 28.

The control apparatus of the present invention may comprise a static pressure sensor 35, which may be static pressure sensor PP905 manufactured by Honeywell, positioned in an output of the fan 22. Sensor 35 supplies a control pressure, dependent upon the static pressure at the output of fan 22, to an amplifier 36 which may be amplifier RP908 also manufactured by Honeywell. The amplifier 36 has a supply of main pressure 37 and provides an output over a pneumatic line 38 the pressure in which depends upon the static pressure being sensed by sensor 35. The pressure in line 38 is supplied to pneumatic motor 39 which is used to control the vortex damper 40 of the fan 22 and is also supplied to a motor 41 for controlling the mixing damper 20. The return air damper 12 and the variable fresh air damper 15 as well as the exhaust damper 42, which controls the amount of air within the building expelled through exhaust duct 43, may be controlled in accordance with my co-pending application 537,301. Moreover the pre-heat coil 18 and cooling coils 19 and 21 may be controlled in the manner shown in the above mentioned co-pending application.

In operation, the static output pressure of the fan is sensed by sensor 35 and is used to regulate the output of the fan 22 and is also used to position the mixing damper 20. As an example, assume that the outdoor temperature is cold such that the variable outdoor air damper 15 is closed. Also assume that the thermostat 33 senses an increasing temperature in the zone 28 and will, therefore, begin to close the damper 29. As the damper 29 closes, the static pressure at the output of the fan 22 will begin to increase and this increasing pressure will be sensed by the static pressure sensor 35. As the pressure at the output of the fan 22 increases, the pressure output in line 38 will also increase an according amount which will cause the motor 39 to begin to close the vortex damper 40 to lower the output of the fan 22. It is to be noted that if the output of the fan 22 is lowered, the amount of air flow being supplied through the minimum outdoor air duct 16 will be lowered. Thus, provision must be made to maintain this minimum outdoor air flow at its pedetermined minimum value. This provision is accomplished by allowing the increasing pressure in line 38 to operate motor 41 to begin to close the damper 20. The operation of damper 20 toward a closing position results in less air being supplied from the mixing chamber 13. The fan, in order to satisfy its requirement to supply enough air to the zones must draw more air, therefore, through the minimum outdoor air damper 17. In this manner, the system maintains a predetermined amount of minimum outdoor air flow from the minimum outdoor air damper duct 16 through the damper 17.

Figure 2:
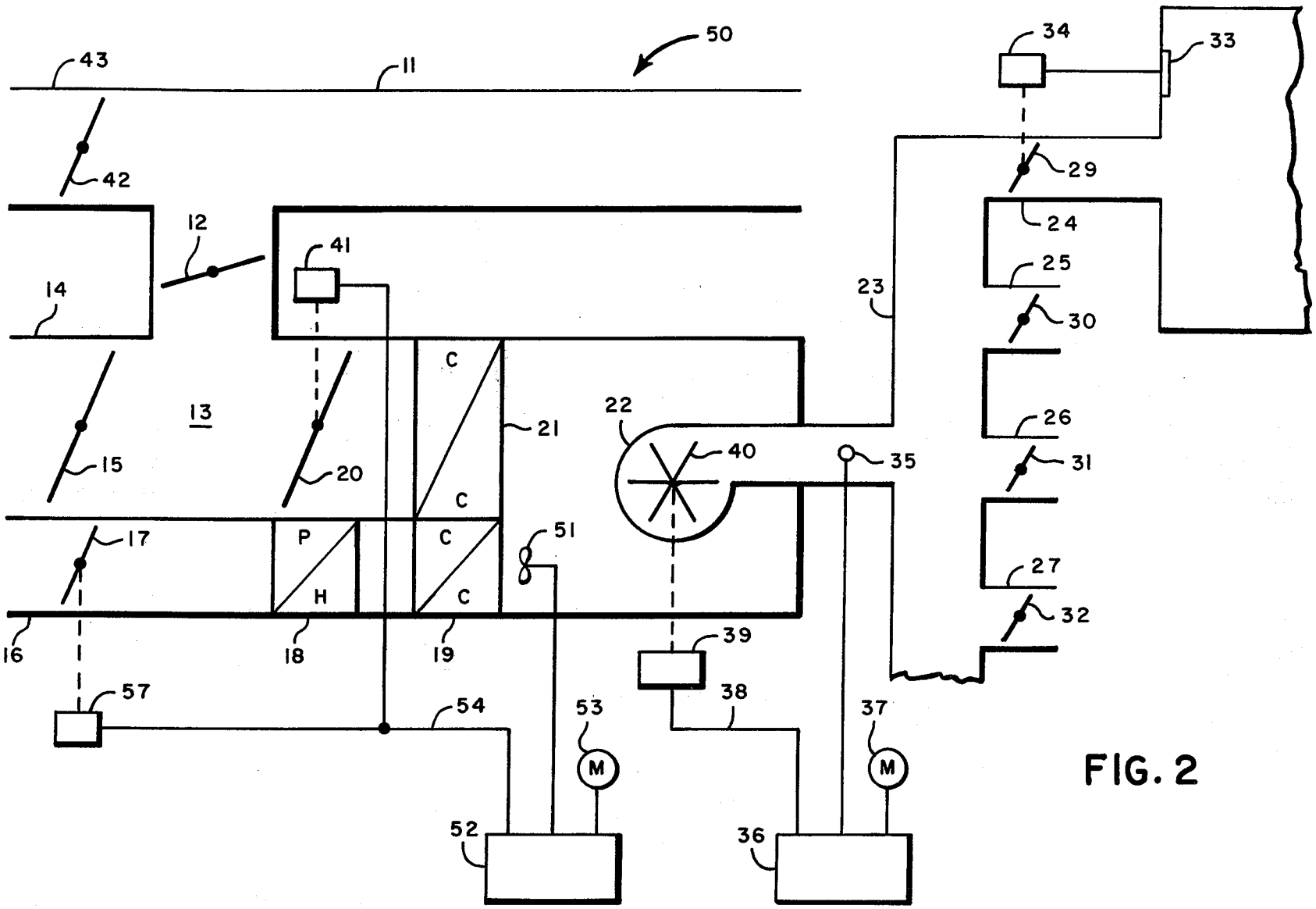

FIG. 2 shows the preferred embodiment of the invention, although it is to be understood that the invention is not to be limited to this particular manner of maintaining the predetermined minimum amount of outdoor air flow into the system. It will be noted that this system 50 is substantially similar to the one shown in FIG. 1 and, therefore, like reference numerals are used. In the case of FIG. 2, the amplifier 36 now only controls the vortex damper 40 of the fan 22. A flow sensor 51 is employed to control the mixing damper 20 as well as the minimum fresh air damper 17. The output from the flow sensor 51 is supplied to an amplifier 52, which may be a RP908 manufactured by Honeywell, Inc., and has a main pressure input at 53 and an output 54. The output pressure in line 54 is supplied to the motor 41 for positioning the damper 20 and is also supplied to a motor 57 for positioning the minimum outdoor air damper 17. The output from amplifier 52 ranges, for example, from 3 psi to 13 psi and the motors 41 and 57 are arranged to hold dampers 20 and 17 at a predetermined position between fully open and fully closed when the output from amplifier 52 is, for example, at 8 psi.

As the output from amplifier 52 increases above 8 psi, corresponding to an increased flow through duct 16, motor 41 is arranged to modulate damper 20 toward a fully open position and motor 57 is arranged to modulate damper 17 toward a predetermined position in the closing direction. As the output from amplifier 52 decreases below 8 psi, corresponding to a decreased flow through duct 16, motor 41 is arranged to modulate damper 20 toward a fully closed position and motor 57 is arranged to modulate damper 17 toward a fully open position.

In the operation of the device shown in FIG. 2, again assume that the outdoor air temperature is cold enough that the variable fresh air damper 15 is closed. Also assume that the thermostat 33 located in zone 28 senses a rise in temperature in the zone 28 and accordingly modulates the position of the damper 29 towards a closed position. This operation of the damper 29 increases the pressure in the discharge duct 23 which in turn results in an increase in the static pressure at the output of the fan 22. This increase in static pressure is sensed by static pressure sensor 35 and will accordingly cause the motor 39 to operate the damper 40 to reduce the output of the fan 22. A reduction in the output of the fan 22 will result in less air being supplied from the mixing chamber 13 and from the minimum fresh air duct 16. As the flow within the duct 16 begins to decrease, the pressure in line 54 also begins to decrease. The motor 41 will therefore modulate the damper 20 toward a closed position and the motor 57 will modulate the damper 17 toward an open position which will force the fan 22 to draw more air through the minimum fresh air duct 16 to satisfy its output requirements. In this manner, the air supplied to the zones will contain the predetermined minimum amount of fresh air from the minimum fresh air duct 16.

In the apparatus shown in FIGS. 1 and 2, the air property sensors have been provided by the static pressure sensor 35 and/or the flow sensor 51 but it is to be noted that other types of air property sensors may be utilized. Air property sensors, for the purpose of this invention, are defined as those sensors, in addition to flow sensors and static pressure sensors, which will sense a condition of air in the air conditioning system to allow for the control of the dampers to maintain a flow of minimum fresh air into the air conditioning system.

The embodiments of the invention in which an exclusive property or right is claimed are defined as follows:

1. An air flow control apparatus for use in an air conditioning system having a source of minimum outdoor air, a source of variable outdoor air, a source of return air, and discharge means for discharging a combination of said outdoor air, variable outdoor air and/or return air to at least one zone, said control apparatus comprising:

damper means for regulating the minimum amount of outdoor air admitted to said system;

air property sensing means for providing an output signal dependent upon the air property in said system; and, control means responsive to said output signal and connected to said damper means for operating said damper means for insuring that said minimum outdoor air is maintained at a substantially predetermined level regardless of the amount of air discharged by said discharge means.

2. The control apparatus of claim 1 wherein said air property sensing means comprises static pressure sensing means for sensing the static pressure of the discharged air.

3. The control apparatus of claim 2 wherein said damper means comprises a damper for controlling a mixture of return air and variable outdoor air and said control means comprises means responsive to the static pressure sensing means for controlling the output of said discharge means and for controlling the position of said damper.

4. The control apparatus of claim 1 wherein said air property sensing means comprises air flow sensing means for sensing the flow of said minimum outdoor air and supplying said output signal.

5. The control apparatus of claim 4 wherein said damper means comprises a minimum outdoor air damper for controlling the source of minimum outdoor air and said control means comprises means responsive to said output signal of said air flow sensing means for controlling said minimum outdoor air damper.

6. The control apparatus of claim 4 wherein said damper means further comprises a mixed air damper for controlling the mixture of said return air and said variable outdoor air and said control means comprises further means for controlling said mixed air damper.

7. The control apparatus of claim 6 wherein said damper means comprises a minimum outdoor air damper for controlling the source of minimum outdoor air and said control means comprises means responsive to said output signal of said air flow sensing means for controlling said minimum outdoor air damper.

8. The control apparatus of claim 4 further comprising static pressure sensing means for sensing the static pressure of the air discharged by said discharge means and further control means connected between said static pressure sensing means and said discharge means for maintaining the static pressure of the air discharged by said discharge means at a predetermined value.

9. The control apparatus of claim 8 wherein said damper means comprises a minimum outdoor air damper for controlling the source of minimum outdoor air and said control means comprises means responsive to said output signal of said air flow sensing means for controlling said minimum outdoor air damper.

10. The control apparatus of claim 8 wherein said damper means further comprises a mixed air damper for controlling the mixture of said return air and said variable outdoor air and said control means comprises further means for controlling said mixed air damper in response to said output signal.

11. The control apparatus of claim 10 wherein said damper means comprises a minimum outdoor air damper for controlling the source of minimum outdoor air and said control means comprises means responsive to said output signal of said air flow sensing means for controlling said outdoor air damper.

12. The control apparatus of claim 10 wherein said air property sensing means comprises static pressure sensing means for sensing the static pressure of the discharged air.

13. The control apparatus of claim 12 wherein said damper means comprises a mixed air damper for controlling a mixture of return air and variable outdoor air and said control means comprises means responsive to the static pressure sensing means for controlling the output of said discharge means and for controlling the position of said mixed air damper.

14. An air flow control apparatus for use in a variable volume air conditioning system having a source of minimum outdoor air, a source of variable outdoor air, a source of return air, discharge means for discharging a combination of said outdoor air, variable outdoor air and/or return air to a plurality of zones, and a damper associated with each zone for controlling the flow of discharged air to that zone, said control apparatus comprising:

damper means for regulating the minimum amount of outdoor air admitted to said system;

air property sensing means for providing an output signal dependent upon the property of air in said system; and, control means responsive to said output signal and connected to said damper means for operating said damper means for insuring that said minimum outdoor air is maintained at a substantially predetermined level regardless of the amount of air discharged by said discharge means.

15. The control apparatus of claim 14 wherein said air property sensing means comprises air flow sensing means for sensing the flow of said minimum outdoor air and supplying said output signal.

16. The control apparatus of claim 15 wherein said damper means comprises a minimum outdoor air damper for controlling the source of minimum outdoor air and said control means comprises means responsive to said output signal of said air flow sensing means for controlling said minimum outdoor air damper.

17. The control apparatus of claim 15 wherein said damper means further comprises a mixed air damper for controlling the mixture of said return air and said variable outdoor air and said control means comprises further means for controlling said mixed air damper.

18. The control apparatus of claim 17 wherein said damper means comprises a minimum outdoor air damper for controlling the source of minimum outdoor air and said control means comprises means responsive to said output signal of said air flow sensing means for controlling said minimum outdoor air damper.

19. The control apparatus of claim 15 further comprising static pressure sensing means for sensing the static pressure of the air discharged by said discharge means and further control means connected between said static pressure sensing means and said discharge means for maintaining the static pressure of the air discharged by said discharge means at a predetermined level.

20. The control apparatus of claim 19 wherein said damper means comprises a minimum outdoor air damper for controlling the source of minimum outdoor air and said control means comprises means responsive to said output signal of said air flow sensing means for controlling said minimum outdoor air damper.

21. The control apparatus of claim 19 wherein said damper means further comprises a mixed air damper for controlling the mixture of said return air and said variable outdoor air and said control means comprises further means for controlling said mixed air damper in response to said output signal.

22. The control apparatus for claim 21 wherein said damper means comprises a minimum outdoor air damper for controlling the source of minimum outdoor air and said control means comprises means responsive to said output signal of said air flow sensing means for controlling said minimum outdoor air damper.

* * * * *